US005509823A

United States Patent [19]

Harting et al.

[11] Patent Number: 5,509,823

[45] Date of Patent: Apr. 23, 1996

[54] ELECTRICAL MATING CONNECTOR

[75] Inventors: Dietmar Harting, Espelkamp; Karin Foerster, Luebbecke; Guenter Pape, Bielefeld, all of Germany

[73] Assignee: Harting Elektronik GmbH, Espelkamp, Germany

[21] Appl. No.: 345,966

[22] Filed: Nov. 28, 1994

[30] Foreign Application Priority Data

Dec. 2, 1993 [DE] Germany ..... 43 41 103.7

[51] Int. Cl.[6] ..... H01R 13/658

[52] U.S. Cl. ..... 439/607; 439/927; 439/931

[58] Field of Search ..... 439/607, 609, 439/86, 108, 89, 931, 533, 544, 557, 590, 593, 597, 600, 540.1, 541.5, 493, 581, 947, 329, 586, 594, 660, 701, 712, 88, 927

[56] References Cited

U.S. PATENT DOCUMENTS

| | | | |
|---|---|---|---|
| 4,401,355 | 8/1983 | Young | 439/939 |
| 4,836,791 | 6/1989 | Grabbe et al. | 439/95 |
| 5,171,167 | 12/1992 | Kosmala | 439/607 |
| 5,344,341 | 9/1994 | Yoshino | 439/607 |

*Primary Examiner*—Neil Abrams
*Assistant Examiner*—Brian J. Biggi
*Attorney, Agent, or Firm*—Jordan and Hamburg

[57] ABSTRACT

An electrical mating connector has a basic body of an insulating material with a collar surrounding the plug-in region of the contact elements, the basic body being provided with a conductive coating for the purpose of shielding and that an interposed, elastic, conductive seal is provided for connecting the coating to a printed circuit board.

20 Claims, 7 Drawing Sheets

ELECTRICAL MATING CONNECTOR

BACKGROUND OF THE INVENTION

The invention relates to an electrical mating connector and, in particular, to a multipoled mating connector for printed circuit boards with means for shielding, the mating connector being constructed essentially rectangularly and having a basic body of an insulating material with a bottom pan with recesses, into which the pin-shaped contact elements are inserted and for which a collar is provided, which surrounds the mating region of the contact element.

Such mating connectors are used for so-called rear-wall wiring systems and serve for transferring signals between a printed circuit board with components, which is provided with a corresponding mating connector, and a wiring printed circuit board, on which the signal leads are shielded, for example, in a multilayer arrangement. Moreover, the signal leads on the printed circuit board with the components are also provided with shielding. For such mating connectors, the signal paths within the mating connection must also be shielded against external interfering effects, the shielding being as gapless as possible.

It is known from a U.S. Pat. No. 4,836,791, to dispose shrouds on the inner longitudinal sides of a knife-edge mating connector. The shrouds are connected on the one hand with an area or strip conductor of the printed circuit board carrying a ground potential and, on the other, with bent, resilient, integrated moldings, which protrude into the interior of the plug-in region of the knife-edge mating connector. When an appropriate mating connector is plugged in, the integrated moldings come into contact with shielding elements mounted on this mating connector.

It is a problem of the known arrangement that the front or narrow sides of the knife-edge mating connector have no shielding whatsoever, so that there is no gapless shielding of the signal leads or signal contacts. Moreover, it is expensive and cost intensive to manufacture and install the shrouds.

SUMMARY OF THE INVENTION

It is an object of the invention to develop a mating connector of the initially named type so that it has gapless shielding of the signal contacts and, moreover, can be manufactured and installed inexpensively.

This object is accomplished owing to the fact that a peripheral recess is molded into the underside, that is, the side of the bottom part facing the printed circuit board, surrounds the region of the contact elements and can be filled with an elastic, electrically conducting sealing material and owing to the fact that the surface of the basic body is provided on all sides—with the exception of the contact regions on the top and bottom sides of the bottom part—with a conductive coating, as well as owing to the fact that the walls of the collar are provided with contacting means, which point into the interior of the collar, for making electrical contact with a mating connector that has been introduced.

The advantages achieved with the invention consist therein that, owing to the all-around metallization of the basic body/insulator of the mating connector, a complete, 360° all-around shielding of the signal contacts within the mating connector is achieved. At the same time, the mating connector can be produced exceptionally inexpensively. The shielding is connected to the printed circuit board by way of an easily handled, conductive seal, which is disposed between the basic body and a strip conductor/metal surface of the printed circuit board, which is at ground potential.

An embodiment of the invention is described in greater detail in the following and shown in the accompanying drawings.

DESCRIPTION OF THE PREFERRED EMBODIMENTS

Figure 1:
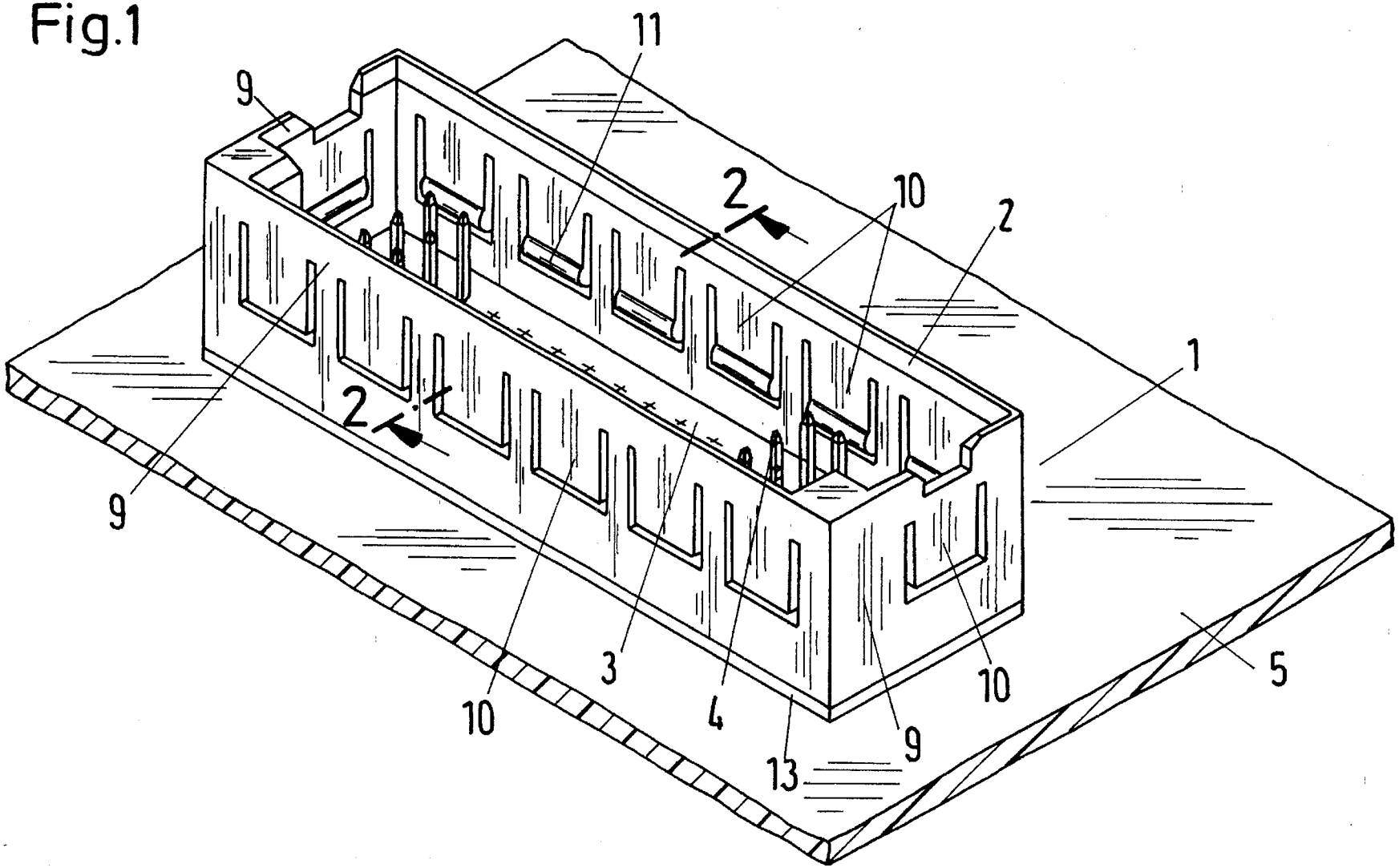
FIG. 1 shows a perspective view of a mating connector.
Figure 2:
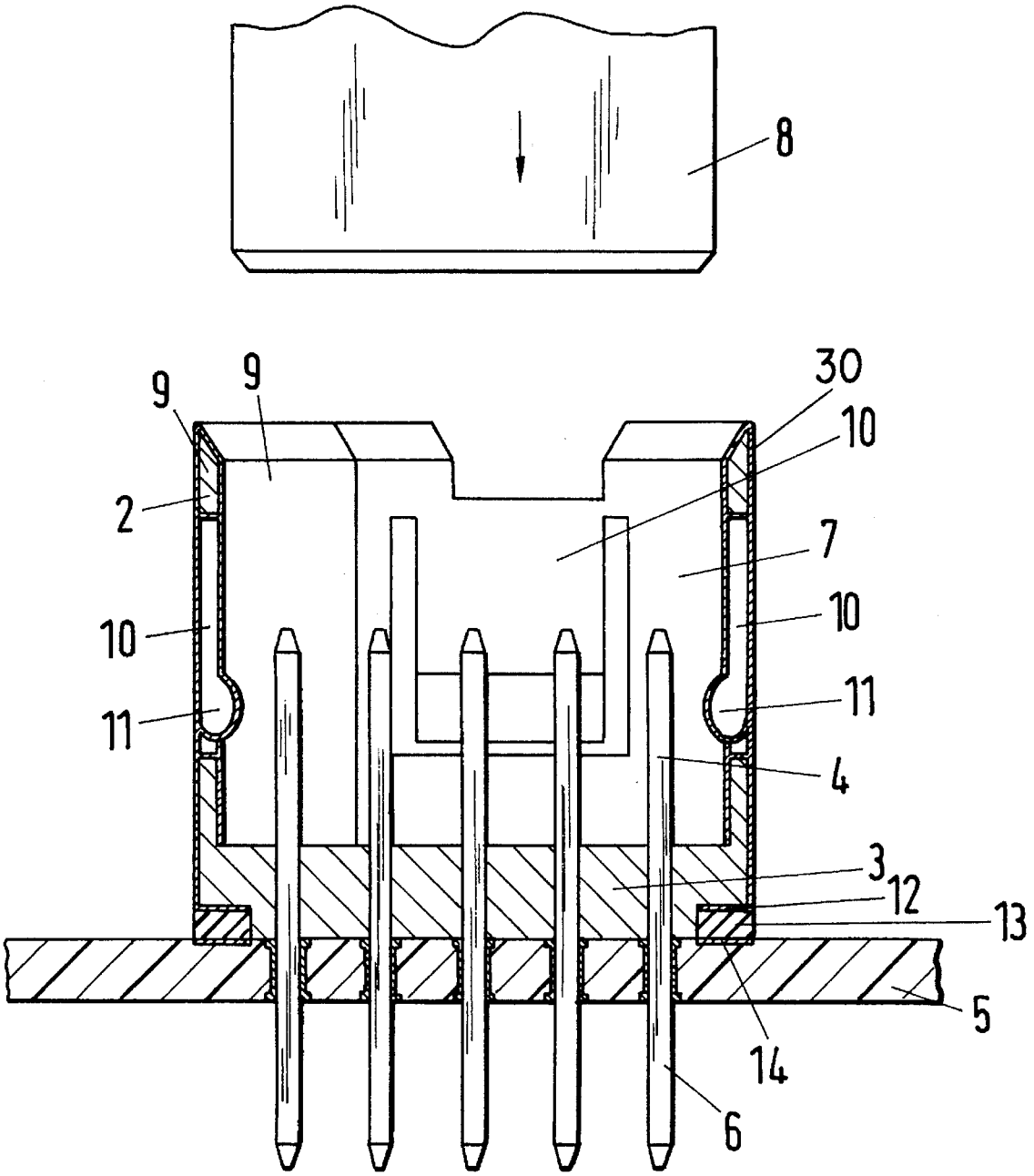
FIG. 2 shows a sectional view of the mating connector of FIG. 1 along the line 2—2.

The mating connector, shown in FIGS. 1 and 2, consists essentially of a basic body 1 of a plastic material with a collar 2 and a bottom part 3, in which pin-shaped contact elements 4 have been inserted. The mating connector has been seated on a printed circuit board 5, the ends 6 of the contact elements being inserted in metallized boreholes and connected with strip conductors. The upper ends of the contact elements protrude into the inner space 7 of the mating connector that is surrounded by the collar 2, where they can make contact with the contact elements of a corresponding mating connector 8, the details of which are not shown here. An example of such a mating connector is disclosed in copending U.S. patent application entitled "Shielded, Printed Circuit Board Plug-In Connector", (Serial No. 08/345,664), of the same three inventors as this instant application and which is being filed in the U.S. Patent and Trademark Office on the same day as this instant application, said copending application being incorporated herein by reference.

The side walls 9 of the collar 2 are provided with elastic tongues 10, which are cut free on three sides and the thickened ends 11 of which point into the interior. Into the side of the bottom part 3 pointing towards the printed circuit board, a peripheral recess 12 has been molded, into which an elastic, conductive seal 13 can be placed. The conductive seal 13 is an elastic seal (for example, of sponge rubber or silicone rubber) which has been made electrically conductive, for example, by the incorporation of graphite or similar conductive particles. The recess or seal surrounds the contact element ends protruding from the bottom part. The surface of the basic body is provided on all sides with a conductive coating 30, in the form of, for example, a metallization of the plastic material. However, in order to avoid short circuits, the top side and the bottom side of the bottom part in the region, in which the contact elements are inserted, are exempted from this conductive coating 30. In the region, in which the sealing material 13 has been placed, the printed circuit board is provided with a metallization 14, which is connected to the ground potential. The elastic seal 13 buffers the parts 3 and 5 elastically, that is, seals them elastically, in order to maintain an elastic pressure. Because the material of the elastic seal 13 at the same time is electrically conductive, a defined contact is ensured between the coating 30 of the insulating body and the strip conductor 14.

Due to the metallized coating 30 all-around of the basic body, shielding of the contact elements within the interior 7 is achieved, the elastic, conductive seal producing the connection between the ground potential of the printed circuit board and the metallization of the basic body. The metallized coating 30 can be made electrically conductive by a galvanic coating (such as Cu/Ni, the Cu providing the conductivity and the Ni the corrosion protection) or by applying (brushing or spraying) conductive lacquers (a conventional lacquer with electrically conductive particles). A consistently uniform thickness of the coating or the metallic coating is desirable. The thickness of the galvanic coating may be generally about 0.1 to 0.2 mm and that of the conductive lacquer generally about 0.5 mm. When a mating connector is inserted with its surface, which preferably is also metallized, the elastic tongues 10 and, in particular, their ends 11 make electrical contact and bring about the continuous shielding of the mating connection.

Figure 3:
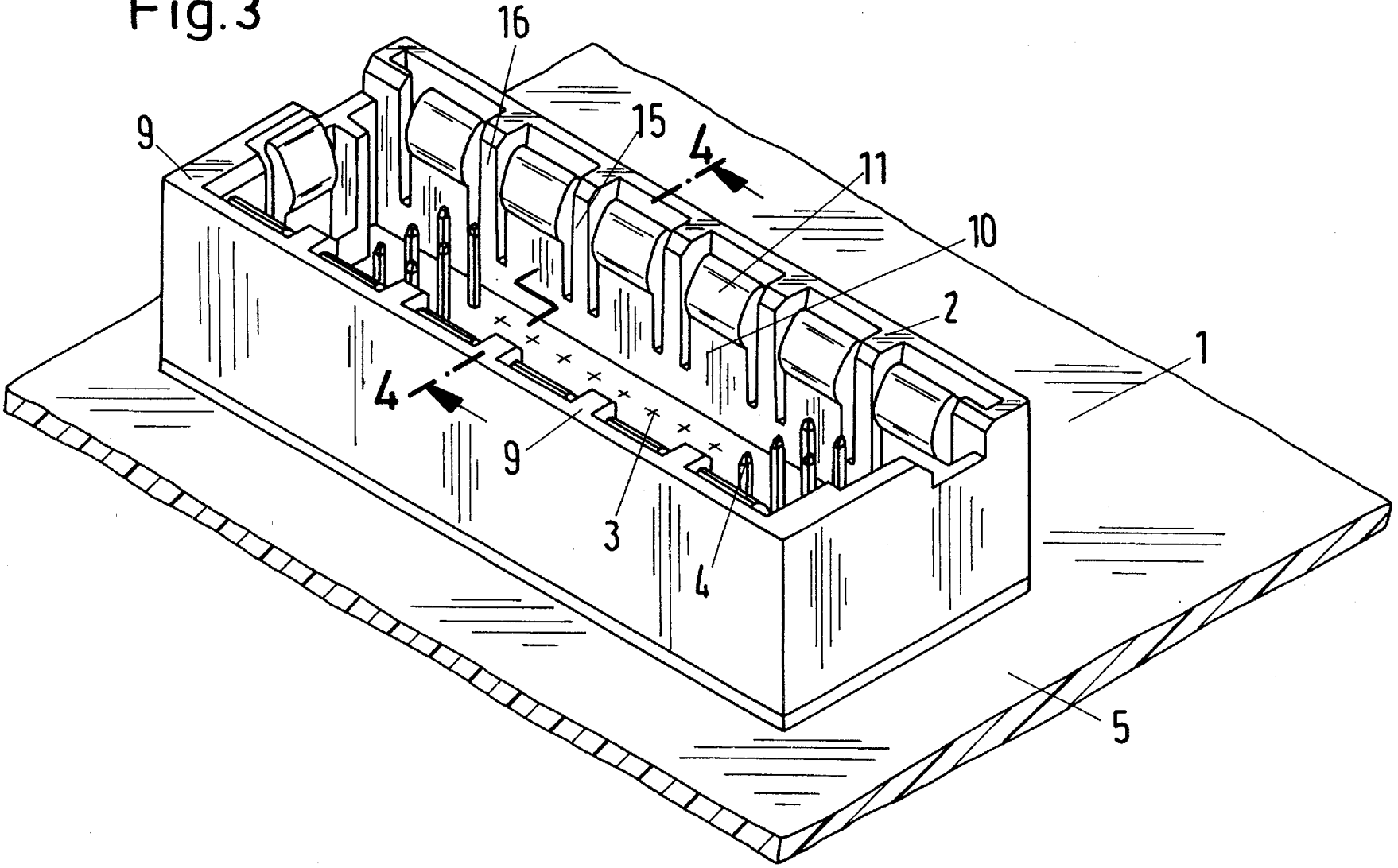
FIG. 3 shows the perspective view of a modified mating connector.
Figure 4:
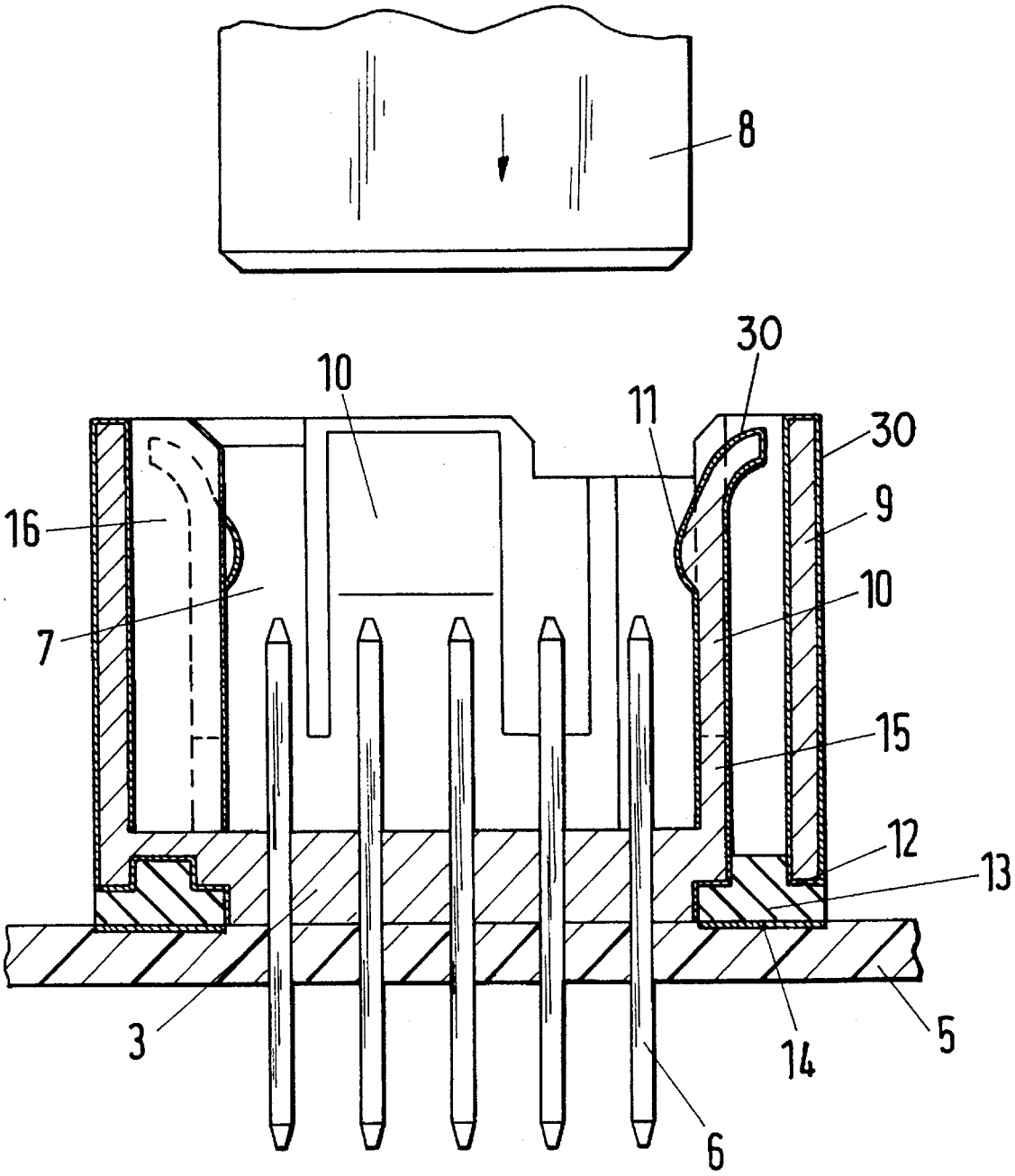
FIG. 4 shows the sectional view of the mating connector of FIG. 3 along the line 4—4.

The mating connector, shown in FIGS. 3 and 4, corresponds essentially to the initially described mating connector, the same reference numbers being used for corresponding pans. However, the outer side walls 9 of this modified connector are completely closed and the elastic tongues 10, cut free, are constructed at the inner wall pans 15. The inner wall pans are connected with the outer side wall by way of the ribs 16. Due to the closed outer side walls, complete shielding of the mating connection is achieved, since the slots of the tongues, cut free, of the version corresponding to FIG. 1 can, under certain circumstances, weaken the shielding for some high frequency applications.

Figure 5:
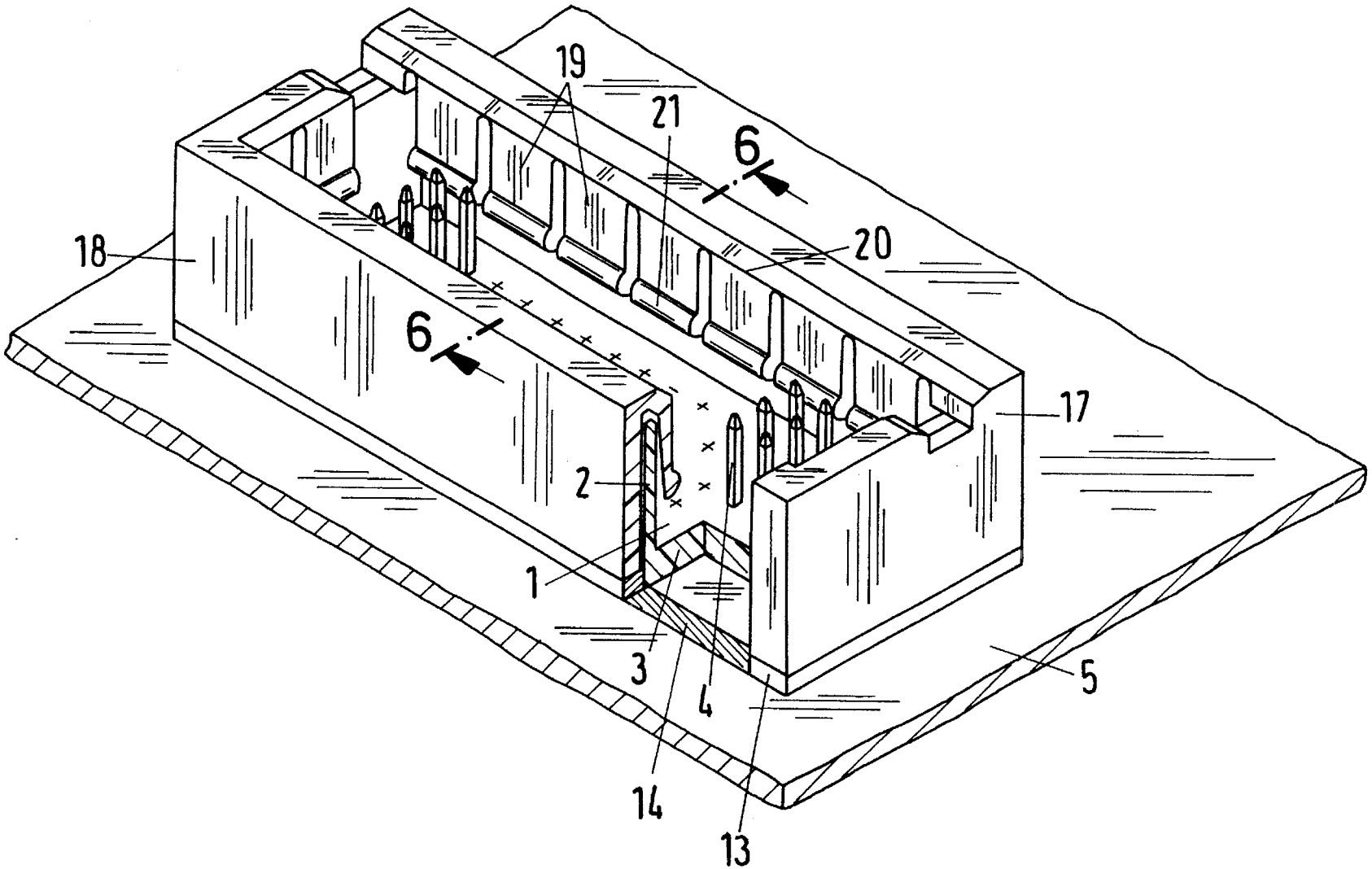
FIG. 5 shows a perspective view of a further modified mating connector.
Figure 6:
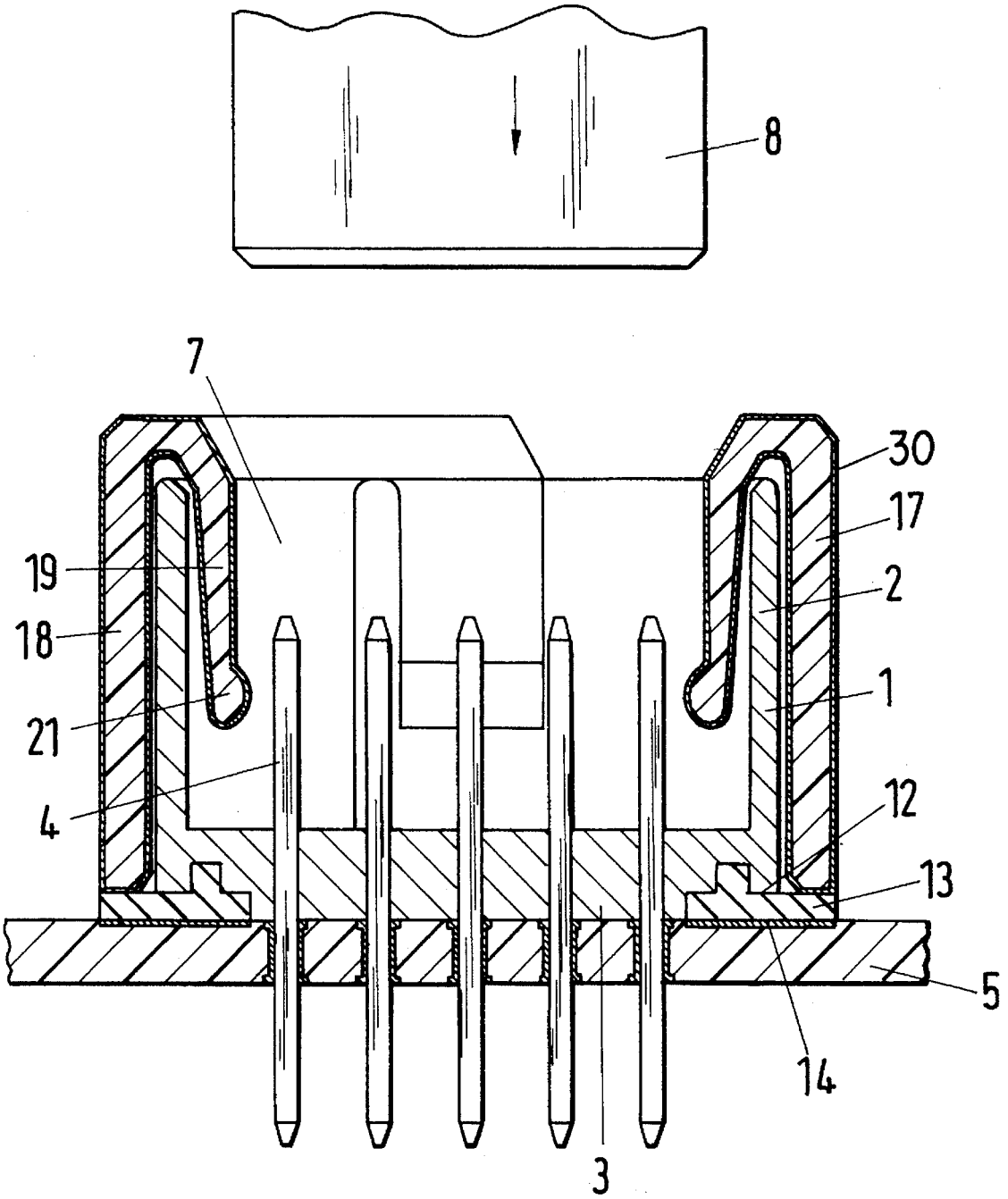
FIG. 6 shows the sectional view of the mating connector of FIG. 5 along the line 6—6.

Finally, a further modified mating connector is shown in FIGS. 5 and 6. This mating connector also consists essentially of a basic body 1 of a plastic material with a collar 2 and a bottom part 3, in which the pin-shaped contact elements 4 are inserted. The bottom part has a peripheral recess 12, into which the elastic, conductive seal 13, which protrudes beyond the basic body 1, is inserted.

A plastic shielding frame 17 is inverted over the basic body 1 and connected to it by means of a suitable material, such as a locking material. The shielding frame has an outer, peripheral closed wall 18 and an inner wall 20, which is provided with tongues 19, cut free on three sides, the two walls being connected together. The distance between the walls 18, 20 corresponds to the thickness of the collar 2 of the basic body 1, so that this collar can be taken up between the walls. The tongues 19, cut free, are elastic and have thickened ends 21, which protrude into the interior 7 of the mating connector. The surfaces of the shielding frame 17 are provided with an electrically conducting coating 30 and the outer wall 18 ends at such a distance from the underside of the bottom part 3, that it presses on the seal 13.

When the mating connector is placed on the printed circuit board 5, the seal between the front side of the wall 18 and the printed circuit board 5 or the metallization 14 is squeezed together and a continuous electrical connection of the metallized surface between the shielding frame and the printed circuit board metallization, which is at ground potential, is achieved.

In much the same way as with the embodiments of a mating connector described above, the thickened ends 21 of the tongues 19 come into contact with metallized surfaces of a mating connector 8 and bring about a reliable connection of the all-around shielding of the mating connection.

Figure 7:
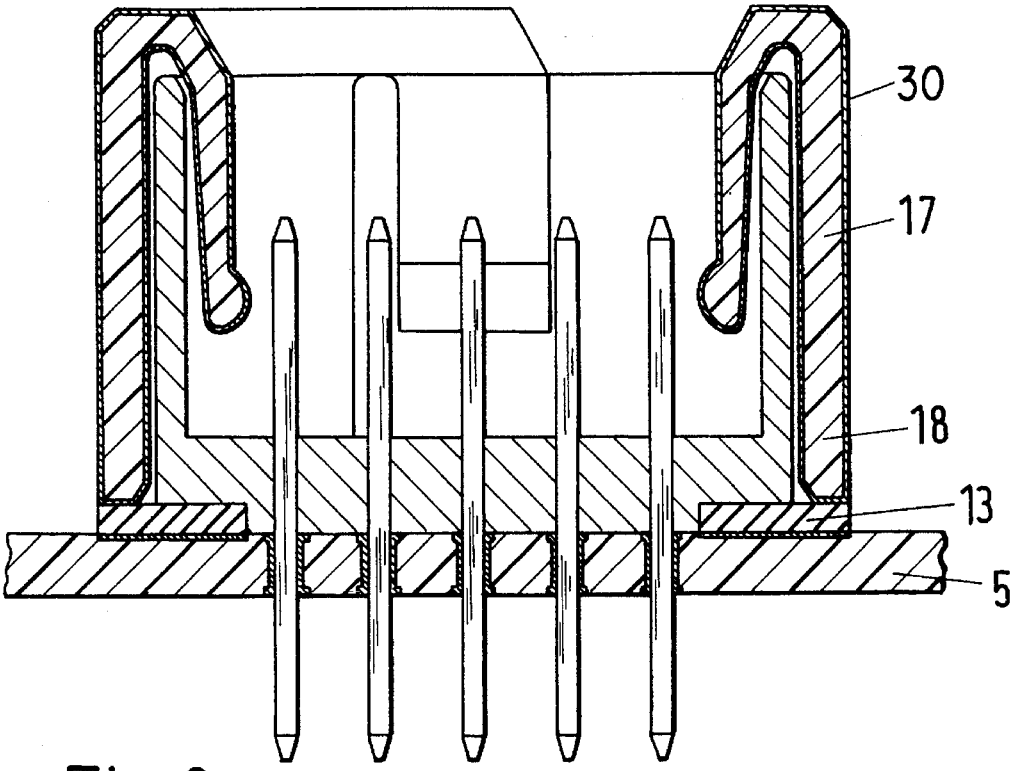
FIG. 7 shows a sectional view of a mating connector with a modified seal.
Figure 8:
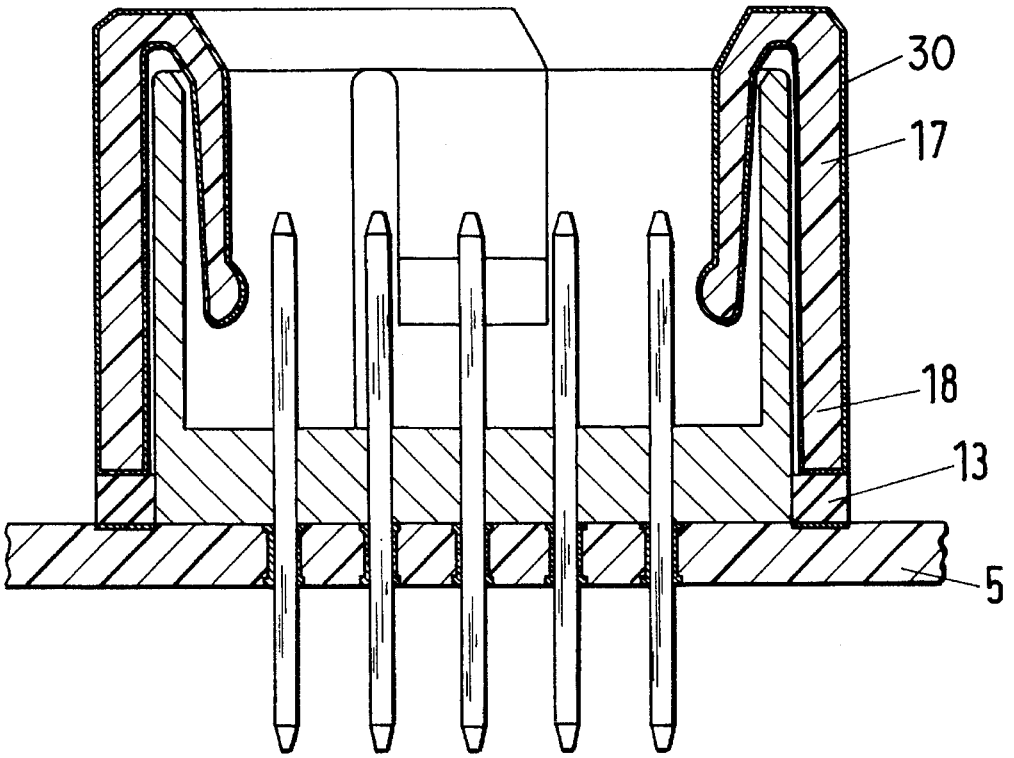
FIG. 8 shows a sectional view of a mating connector with a seal, which has been modified further.

For the sake of completeness, modified conductive seals and their arrangement are shown in FIGS. 7 and 8. In FIG. 7, a flat seal is shown, which is inserted in a simple recess in the bottom part, while in FIG. 8, the bottom part is constructed without a recess and the seal is streaked over the basic body in the region of the bottom part until it lies against the shielding frame, before the mating connector is installed on the printed circuit board. It is self evident that the seal has a certain "overmeasure" in all cases, so that it is squeezed between the shielding frame and the printed circuit board when the mating connector is put in place.

What we claim is:.

1. An electrical connector for a circuit board operable to be connected with a mating connector, the electrical connector comprising a connector body made of an insulating material, said connector body forming a recess having a bottom part and a recess wall means extending from said bottom part, said bottom part having passages, contact elements passing through circuit passages and extending into said recess, said bottom part being disposed on said circuit board, conductive sealing means between said connector body and said circuit board providing an electrically conductive seal means between said connector body and said circuit board, contact means on said recess wall means disposed to face said recess, and a conductive coating on said recess wall means and on said contact means, said contact means making electrical contact with an interconnected mating connector disposed in said recess.

2. An electrical connector according to claim 1 wherein said conductive sealing means comprises receiving means in said bottom part of said connector body, said conductive sealing means further comprising an elastic and conductive sealing material disposed in said receiving means.

3. An electrical connector according to claim 2 wherein said receiving means comprises a recess in said bottom part of said connector body, said elastic and conductive sealing material being disposed in said recess.

4. An electrical connector according to claim 1 wherein said contact meads comprises thickened projections projecting from said recess wall means and facing said recess, said thickened projections contacting said interconnected mating connector disposed in said recess.

5. An electrical connector according to claim 1 wherein said recess wall means has integrally formed flexible tongues which biasingly contact said interconnected mating connector disposed in said recess.

6. An electrical connector according to claim 5 wherein each of said tongues is a three-sided tongue formed by three cut-outs in said recess wall means.

7. An electrical connector according to claim 5 wherein said tongues have tongue end portions and a thickened section on said tongue end portion facing said recess, said thickened section engaging said interconnected mating connector disposed in said recess.

8. An electrical connector according to claim 1 wherein said recess wall means comprises a recess wall structure and a frame means disposed on said recess wall structure, said conductive coating extending over said frame means, said frame means having an inside section facing said recess, said inside section of said frame means making electrical contact with said interconnected mating connector disposed in said recess.

9. An electrical connector according to claim 8 wherein said conductive coating extends between said frame means and said conductive seal means and between said circuit board and said conductive seal means.

10. An electrical connector according to claim 8 wherein said inside section of said frame means has flexible tongues integrally formed with said inside section, said tongues being operable to biasingly contact said interconnected mating connector disposed in said recess.

11. An electrical connector according to claim 10 wherein said conductive coating extends over said frame means including said tongues.

12. An electrical connector according to claim 8 further comprising an elastic and electrically conductive sealing material between said frame means and said circuit board.

13. An electrical connector according to claim 8 wherein said recess wall structure has a terminating end along with an inside face and an outside face, said frame means having a generally U-shaped cross-sectional configuration having spaced leg walls and an end wall, said recess wall structure being disposed in said U-shaped configuration such that said terminating end of said recess wall structure is juxtaposed to said end wall of said recess and said inside and outside faces of said recess wall structure are juxtaposed to the respective spaced leg walls.

14. An electrical connector according to claim 1 wherein said recess wall means comprises a recess wall structure and a plurality of flexible tongues juxtaposed to said recess wall structure, said flexible tongues and said recess wall structure being connected to said bottom part.

15. An electrical connector according to claim 14 wherein said recess wall structure, said tongues and said bottom part are integrally formed as a one-piece unit.

16. An electrical connector according to claim 14 wherein said recess wall means further comprises integrally formed ribs extending from said recess wall structure toward said recess, said ribs being disposed on either side of said flexible tongues.

17. An electrical connector according to claim 14 wherein said flexible tongues are spaced from said recess wall structure.

18. An electrical connector according to claim 16 wherein said ribs have an inner rib wall facing said recess, said flexible tongues having thickened projections which extend beyond said inner rib wall of said ribs into said recess.

19. An electrical connector according to claim 18 wherein said conductive coating extends over said recess wall structure, said flexible tongues, said ribs and said thickened projections.

20. An electrical connector for a circuit board operable to be connected with a mating connector, the electrical connector comprising a connector body made of an insulating material, said connector body forming a recess having a bottom part and a recess wall means extending from said bottom part, said bottom part having passages, contact elements passing through said passages and extending into said recess, said bottom part being disposed on said circuit board, said recess wall means comprising a recess wall structure and a frame means disposed on said recess wall structure, electrically conductive seal material between said frame means and said circuit board providing an elastic and electrically conductive seal between said frame means and said circuit board, contact means on said frame means disposed to face said recess, and a conductive coating on said frame means and on said contact means, said contact means making electrical contact with an interconnected mating connector disposed in said recess.

* * * * *